US007060888B2

(12) United States Patent
Spalt

(10) Patent No.: US 7,060,888 B2
(45) Date of Patent: Jun. 13, 2006

(54) MOVABLE STRINGED INSTRUMENT PICKUP SYSTEM

(76) Inventor: Michael Sebastian Spalt, 1316 Manzanita St., Los Angeles, CA (US) 90027

( * ) Notice: Subject to any disclaimer, the term of this patent is extended or adjusted under 35 U.S.C. 154(b) by 106 days.

(21) Appl. No.: 10/728,250

(22) Filed: Dec. 4, 2003

(65) Prior Publication Data

US 2005/0120871 A1 Jun. 9, 2005

(51) Int. Cl.
*G10H 3/14* (2006.01)

(52) U.S. Cl. ..... 84/727; 84/735; 84/741

(58) Field of Classification Search ..... 84/723–732, 84/735, 741

See application file for complete search history.

(56) References Cited

U.S. PATENT DOCUMENTS 3,780,202 A * 12/1973 Law ..... 84/726
3,869,952 A * 3/1975 Rowe ..... 84/727
3,911,777 A * 10/1975 Rendell ..... 84/743
4,261,240 A * 4/1981 Aaroe ..... 84/739
5,012,716 A * 5/1991 Pagelli ..... 84/727

* cited by examiner

*Primary Examiner*—Marlon T. Fletcher
*Assistant Examiner*—David S. Warren
(74) *Attorney, Agent, or Firm*—Aaron McGushion

(57) ABSTRACT

A pivoting electromagnetic pickup device is provided. The invention generally is comprised of an elongated support structure, an electromagnetic pickup, a pivoting means, and an angular position locking means. The extremity of the elongated support structure is pivotally attached to the front face of an electric guitar or electric base body, between the front face and the strings, restricting its movement to a curvilinear path substantially normal to the axis of rotation and substantially parallel to the plane of the strings. The pickup is mounted to the elongated support structure, between the elongated support structure and the strings. Attaching the elongated support structure to the guitar body in a pivotal relationship is the pivoting means. The angular position locking means can be engaged to continuously vary the resistance to angular motion, from no resistance to maximum resistance, where the elongated support structure is substantially locked to a chosen angular position.

8 Claims, 2 Drawing Sheets

MOVABLE STRINGED INSTRUMENT PICKUP SYSTEM

BACKGROUND OF INVENTION

This invention relates to stringed musical instruments in general and, more particularly, to electric guitars and basses having a movable electromagnetic pickup.

The initial design of electric stringed instruments, such as electric guitars and basses, included an electromagnetic pickup device, to detect the mechanical waves of the strings within the magnetic field; and, in turn, the magnetic disturbance is converted to an electric signal, transmitted to a sound amplifying means. The single pickup was positioned under the strings, at a fixed position. In order to improve the musical performance and flexibility of stringed instruments, multiple pickup and movable pickup devices were soon introduced.

The purpose of positioning the pickup along different sections of the vibrating strings is to affect a change in the sound quality of the instrument. The closer a pickup is to the bridge of a stringed instrument, the more it will pick up treble frequencies. As it is positioned closer to the neck part of the instrument, it will increasingly favor bass response. Furthermore, there are, along the vibrating strings, harmonic nodes, locations where the harmonic content of the plucked note is emphasized. These are called sweet spots. Depending on scale length, tuning and the actual note played these sweet spots vary. A movable pickup or multiple pickups can be placed in a location to attempt to capture the desired tonal characteristic.

A stringed instrument with multiple fixed pickups attempts to capture these varying characteristics but is limited by the fixed location of the pickups. To achieve intermediate sounds, output from two pickups must be electronically mixed, resulting in phase shifts; since the two pickups simultaneously record a slightly different waveform of the vibrating string. The musician loses flexibility and precision when using a multiple pickup instrument. This disadvantage has led to development of movable pickup mounting designs.

The first type of movable pickup commonly used is the sliding pickup. The sliding pickup devices are again positioned under the strings. However, the pickup is mounted on a linear translating mechanism, such as a rail. The pickup can be moved longitudinally along a straight path, generally parallel to the path of the strings. The sliding pickup designs have the advantage of more effectively shaping the tonal characteristics of the instrument by allowing placement of the pickup at multiple discrete locations along the string path.

There are, however several drawbacks to the sliding pickup design. Many of these sliding pickups were designed to be positioned before play, and not during play. Alternatively, the position, directly beneath the strings, made it difficult to reposition the pickup during play. If the musician wishes to change the tonal characteristic of the instrument throughout a piece of music, repositioning the sliding pickups may result in an interference of the performance. Another disadvantage of the sliding pickup is the possibility of the pickup mechanism jamming during a transition. If the sliding pickup were to become askew in relation with the rail mechanism, jamming or chattering may result.

A rotating pickup design places the pickup at different angles relative to the string path, which results in shifts in tone, as shown in Pagelli U.S. Pat. No. 5,012,716. Although the rotating disc revealed in '716 can be manually adjusted during play, the maximum angular displacement, wherein the pickups are in continuous electromagnetic communication with the strings, is limited. When exploring a pickup angle in relation to the strings, the musician must keep in mind that the pickups must remain in close proximity directly below the strings. To achieve full communication with all strings, the rotation angle must be limited. The multiple pickups of '716 additionally have the drawbacks discussed previously.

The multiple pickup, sliding pickup, and rotating pickup designs mentioned above, do affect the tonal characteristics of the instrument; however, they all have mechanical and artistic limitations due to their design. Most sliding designs are cumbersome in use and prone to mechanical failure in the field while rotating designs are severely limited in the range of tonal manipulation they offer.

What is needed is a moveable electromagnetic pickup to capture desired tonal characteristics. What is additionally needed is a moveable electromagnetic pickup that is easily moved during play. Further, what is needed is a moveable electromagnetic pickup that will not jam or chatter as it is being moved. What is additionally needed is a moveable electromagnetic pickup that is simple in design and easily manufacturable.

SUMMARY OF THE INVENTION

In accordance with the present invention, a pivoting electromagnetic pickup device is provided. The invention generally is comprised of an elongated support structure, an electromagnetic pickup, a pivoting means, and an angular position locking means. The extremity of the elongated support structure is pivotally attached to the front face of an electric guitar or electric base body, between the front face and the strings, restricting its movement to a curvilinear path substantially normal to the axis of rotation and substantially parallel to the plane of the strings. The electromagnetic pickup is mounted in a substantially fixed position to the elongated support structure, between the elongated support structure and the strings. The elongated support structure and electromagnetic pickup form a pickup assembly. Attaching the elongated support structure to the electric guitar body in a pivotal relationship is the pivoting means. The angular position locking means can be engaged to continuously vary the resistance to angular motion, from no resistance to maximum resistance, where the elongated support structure is substantially locked to a chosen angular position. The angular locking means can be set to any intermediate resistance position, to adjust the force required to rotate the device.

The strings of the instrument closest to the pivoting means have higher frequency characteristics, and the strings furthest have lower frequency characteristics. In order for the pickup detect a consistent tonal change in all strings for a given pickup movement, the arc distance the portion of the pickup beneath the high frequency strings travels should be less than the arc distance the portion of the pickup beneath the low frequency strings. In this way, the distance the pickup travels, relative to each individual string, varies according to the strings radius from the pivoting means. Although, the phase shift for each string, can be made to be approximately equal. The pivoting means being located at the extremity of the elongated support structure provides this consistent tonal change.

In a preferred embodiment an adjustable nut engaged on a threaded post with friction washers is used as pivoting means for the pickup assembly. The frictional force exerted by the nut determines the ease with which the wiper arm may be moved and, when engaged with sufficient torque, will cause the arm to stop and remain in the position selected. The nut can be a knurled nut, wing nut, or any other fastening means that will achieve the effect of increasing or decreasing torque when engaging or disengaging respectively.

Furthermore, in the preferred embodiment, the pickup assembly is restricted to a sector of a curvilinear path by a limiting means. This limiting means can be any number of devices that can restrict the motion of the pickup assembly to a predefined sector. The limiting means can be a wall, pin, or a means to limit the rotation at the pivoting means.

To provide ample clearance between the pickup assembly and the strings, a recess is formed in the body, from the front face, beneath the strings. The shape of the recess is of sufficient area to accommodate the curvilinear path of the pickup assembly without substantial mechanical interference. Additionally, the recess is of sufficient depth to prevent substantial physical contact between the pickup assembly and the strings. The all or a portion of the pickup assembly is positioned within the recess, pivotally mounted to the bottom surface of the recess. The walls of the recess may also act as a limiting means, defining the boundary of rotation.

The elongated support structure can be manufactured from various materials, using known woodworking, machining, or molding techniques. The elongated support structure can be made from material including wood, plastic, metal, or any other useful material. Additionally, the elongated support structure and the framework of the coil for the electromagnetic pickup may be produced as one unit.

Additionally, in the preferred embodiment, there is a means for electronically connecting the electromagnetic pickup to the electronics cavity of the stringed instrument, preferably a wire. The wire, being of sufficient gauge and capacity to carry the necessary signal, runs from the electromagnetic pickup, through a channel in the elongated support structure, to a respective channel routed into the body near the pivoting means of the elongated support structure, so that it remains flexibly connected at all times to the electronics cavity in the electric guitar or electric bass body.

In an alternate embodiment of the present invention, the pickup assembly again rotates about a pivot; however, the planar path normal to the axis of rotation is not parallel to the plane of the strings. Instead, the planar path diverges away from the plane of the strings as the pickup assembly is rotated from the bridge to the neck of the guitar. This action positions the pickup assembly progressively closer to the strings as it moves towards the bridge, thus counteracting the diminution in volume caused by the reduced vibrational energy exerted by the strings in proximity of the bridge. As the pickup assembly is moved closer to the neck of the instrument, increased vibrational energy from the strings will cause the volume output to rise. This increase in volume is counteracted by positioning the pickup assembly further from the strings. Therefore, the rate of divergence between the pickup assembly and strings can be adjusted to maintain constant volume output throughout the range of motion of the pickup assembly.

DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
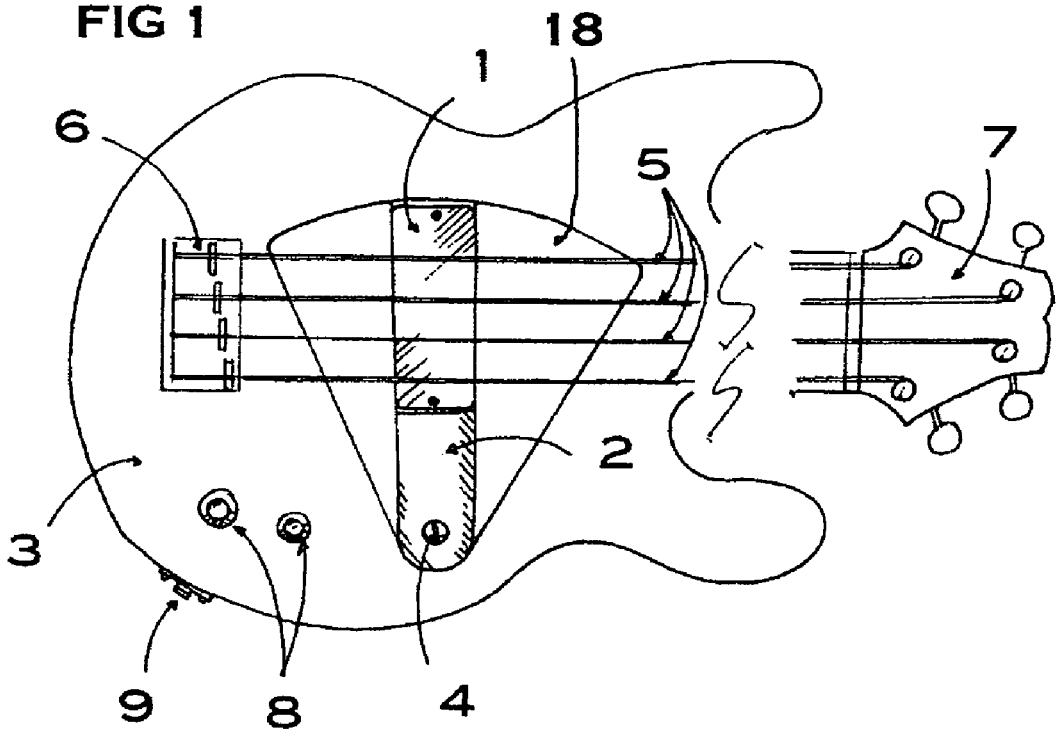
FIG. 1 is a plan view of the pickup assembly situated on the body of a guitar.

A top view of an electric stringed musical instrument, in this preferred embodiment a 4-string bass guitar, is shown in FIG. 1, having a neck and headstock with tuning mechanisms (7), strings (5) which are anchored to the body (3) by the bridge (6). The pickup (1) is shown mounted on the elongated support structure (2), in this preferred embodiment attached to the body (3) of the instrument by a screw (4). The pickup (1) may be pivoted back and forth in the sector shaped recess (18) formed in the body (3). The recess (18) defines the range of movement available to the elongated support structure (2). It also allows the assembly of elongated support structure (2) and pickup (1) to be substantially flush with the top of instrument body (3), thus preventing it from interfering with the musician's play. Additionally, the location of the elongated support structure (2) provides ample area to locate the volume and tone knobs (8) and the jack socket (9).

While playing, the musician may apply pressure by placing the thumb on the top end of the pickup (1) farthest from the pivot point at the screw (4) to easily adjust the position of the pickup (1). Adjustment of the screw (4) will result in more or less friction being applied to the elongated support structure (2), thus enabling the selection the proper tension for the musician's playing style. He may also find a "sweet spot" and tighten the screw (4) to maintain the pickup (1) and elongated support structure (2) permanently in a desired position.

Additionally, the pickup (1) will provide the musician with a thumb rest in the appropriate playing position for the respective tonality desired. Specifically, a bass player's hand will move closer to the bridge (6) when brighter sounds are desired, corresponding to the position of the pickup (1) and elongated support structure (2), or conversely, closer to the tuning mechanisms (7) for warmer tones. The range of movement of the pickup (1) covers most of the commonly desirable positions and additionally allows for an almost infinite number of alternate positions. It has been found that the present invention greatly enhances the versatility and usefulness of a standard stringed musical instrument by enabling the musician to tailor the sound quickly and effectively to the personal playing style.

Figure 2:
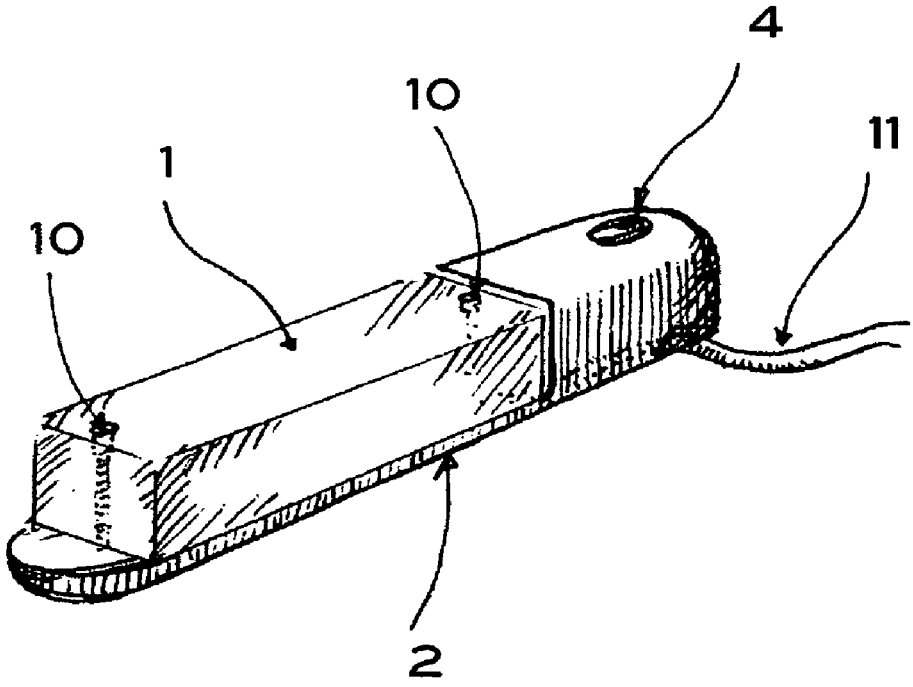
FIG. 2 is a perspective view of the pickup assembly.

FIG. 2 shows a view of the elongated support structure (2) with attached pickup (1) assembled. The attachment screws (10) fasten the pickup (1) to the elongated support structure (2). A leaf spring or other resistance means can be used to exert upward pressure to counteract the downward pressure of the screws (10) so the pickup (1) can be raised or lowered with respect to the elongated support structure (2), to allow for adjustment of the gap between the strings (5) and the pickup (1).

Figure 3:
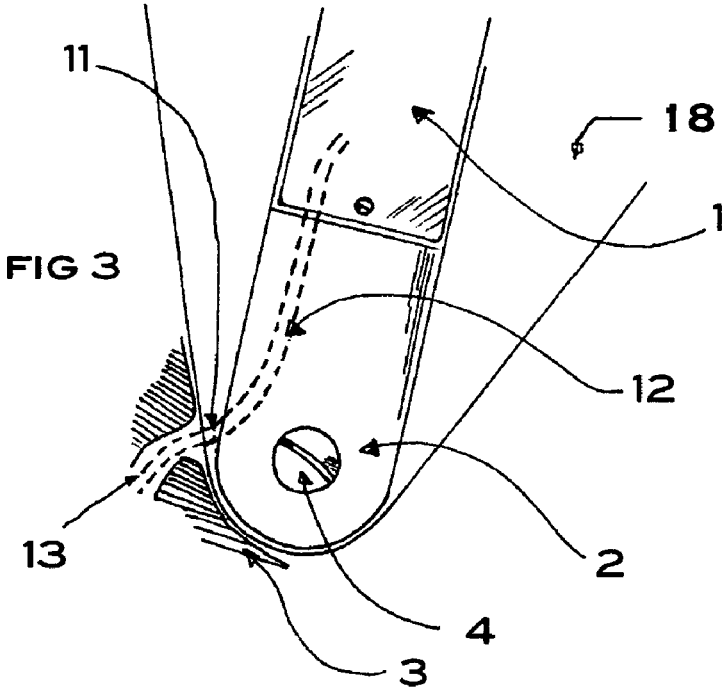
FIG. 3 is a top view of the pickup assembly with the communication wire in phantom connecting the pickup to the body cavity.

As can be seen in FIG. 3, the cable (11) runs from the pickup (1) in a passage (12) at the bottom of the elongated support structure (2), exits near the screw (4) and enters the body (3) by means of the opening (13).

Figure 4:
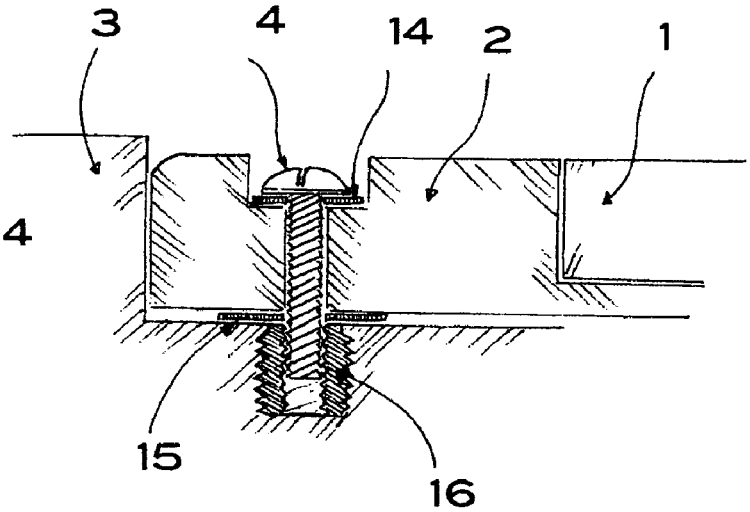
FIG. 4 is a side cut-away view of the pivot screw attachment and pickup assembly.

FIG. 4 shows a cutaway of the elongated support structure (2) with the screw (4) of the preferred embodiment. Alternately a knurled thumb screw or other screw design may be substituted. The primary purpose is to produce friction by the normal force of the screw; which causes the wiper arm to remain in the selected position, and to adjust the friction quickly and effectively during play. Washers (14) and (15) allow the elongated support structure (2) to move while retaining the screw (4) in its position in the threaded insert (16).

Furthermore, the arc of the elongated support structure (2) may be limited or expanded to angle the pickup (1) more or less with respect to the strings (5), thus producing more or less extreme tonal effects. Additionally, the elongated support structure (2) may be longer or shorter, and thus effect subtle changes in the geometry of the sensing arc.

Figure 5:
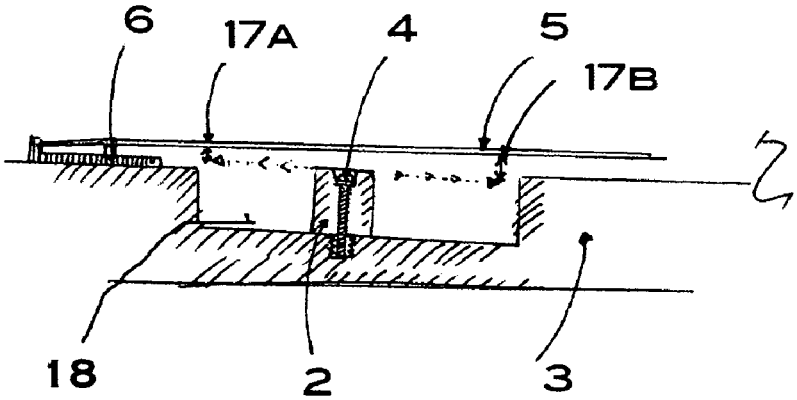
FIG. 5 is a side cut-away illustrating the slanting sliding plane as the pickup moves towards or away from the bridge.

In addition the plane of the elongated support structure's (2) arc is lightly sloped with respect to the strings (5), to position the pickup (1) progressively closer to the strings (5) as it moves towards the bridge (6), counteracting the diminution in volume effected by the reduced vibrational energy exerted by the strings (5) in proximity of the bridge (6). FIG. 5 illustrates a cutaway view of the body (3) with the recess (18) routed to create a slope, positioning the pickup (1) closer to the strings (5) at the endpoint of the arc (17A) near the bridge (6), counteracting the diminution of string energy encountered near the witness point at the bridge (6). As the elongated support structure (2) with the pickup (1) is moved closer to the neck of the instrument, increased vibrational energy from the strings (5) will cause the volume output to rise. This is counteracted by positioning the pickup (1) further from the strings (5) at the end point of the arc (17B).

While the present invention has been described with regards to particular embodiments, it is recognized that additional variations of the present invention may be devised without departing from the inventive concept.

I claim:

1. A pivoting electromagnetic pickup for a stringed instrument comprising:

an elongated support structure, said elongated support structure being attached in a pivotal relationship to said stringed instrument at a pivot point, restraining said elongated support structure to a curvilinear path, said stringed instrument having a body and a plurality of strings, said strings being offset and substantially parallel to said body, said elongated support structure being mounted substantially between said body and said strings;

an electromagnetic pickup, said electromagnetic pickup being fixed to said elongated support structure between said strings and said elongated support structure, said electromagnetic pickup being of sufficient length to be in continual electromagnetic communication with said strings throughout said curvilinear path, said elongated support structure and electromagnetic pickup forming a pickup assembly;

a pivoting means, said pivoting means securing in a rotatable relationship said elongated support structure to said body, said pivoting means engaging said elongated support structure substantially near a terminus, said pivoting means providing an axis of rotation for said curvilinear path of said pickup assembly;

an angular position locking means, said angular position locking means being manually engaged at any position along said curvilinear path, said angular position locking means substantially preventing rotation of said elongated support structure from a set angular position, said angular position locking means allowing free rotation of the pickup assembly in a disengaged state;

wherein said pivot point is located on said body at a sufficiently distant point from an area immediately beneath said strings to allow said pickup to effectively transition to produce sul ponticello and sul tasto tone qualities;

and wherein said pickup assembly can be set to an angular position before or during play to achieve a desired musical effect.

2. The pivoting electromagnetic pickup of claim 1 wherein said pickup assembly being mounted within a recess formed in said body, said recess being of sufficient area to accommodate said curvilinear path of said pickup assembly without substantial mechanical interference of said pickup assembly, said recess being of sufficient depth to prevent substantial contact between said pickup assembly and said strings.

3. The pickup assembly of claim 2 wherein said recess defines a boundary, said boundary restricting said curvilinear path to a specified sector.

4. The pivoting electromagnetic pickup of claim 1 wherein said angular position locking means is a nut threadably engaged to said pivoting means, said nut frictionally engaging said pickup assembly.

5. The angular position locking means of claim 4 wherein the torque of said nut is adjusted to vary the resistance to the rotation of the pickup assembly.

6. The angular position locking means of claim 4 wherein said nut is a knurled nut.

7. The pivoting electromagnetic pickup of claim 1 wherein said curvilinear path is an arc.

8. A pivoting electromagnetic pickup for a stringed instrument comprising:

an elongated support structure, said elongated support structure being attached in a pivotal relationship to said stringed instrument at a pivot point, restraining said elongated support structure to a curvilinear path, said stringed instrument having a body and a plurality of strings, said strings being offset and substantially parallel to said body, said elongated support structure being mounted substantially between said body and said strings;

an electromagnetic pickup, said electromagnetic pickup being fixed to said elongated support structure between said strings and said elongated support structure, said electromagnetic pickup being of sufficient length to be in continual electromagnetic communication with said strings throughout said curvilinear path, said elongated support structure and electromagnetic pickup forming a pickup assembly;

a pivoting means, said pivoting means securing in a rotatable relationship said elongated support structure to said body, said pivoting means engaging said elongated support structure substantially near a terminus, said pivoting means providing an axis of rotation for said curvilinear path of said pickup assembly;

wherein said curvilinear path is generally divergent from the path of the strings as said curvilinear path moves from a bridge to a neck of said stringed instrument, a gap formed between said strings and said electromagnetic pickup increasing in width as said pickup assembly is moved along said curvilinear path from said bridge to said neck;

and wherein a diminution in volume caused by a reduced vibrational energy exerted by said strings in proximity of said bridge is counteracted to maintain constant volume by positioning said electromagnetic pickup increasingly closer to said strings as said pickup assembly is moved towards said bridge;

and wherein an augmentation in volume caused by an increased vibrational energy exerted by said strings in proximity of said neck is counteracted to maintain constant volume by positioning said electromagnetic pickup increasingly further from said strings as said pickup assembly is moved towards said neck.

* * * * *